US005541635A

United States Patent [19]

Wills et al.

[11] Patent Number: 5,541,635

[45] Date of Patent: Jul. 30, 1996

[54] PRINTER MECHANISM

[75] Inventors: David C. Wills, Cambridge; Raymond J. Ichrist, Galena, both of Ohio

[73] Assignee: Mettler-Toledo, Inc., Worthington, Ohio

[21] Appl. No.: 210,955

[22] Filed: Mar. 18, 1994

[51] Int. Cl.[6] ..... B41J 25/304

[52] U.S. Cl. ..... 347/197

[58] Field of Search ..... 400/120.16, 120.17; 347/197, 198

[56] References Cited

U.S. PATENT DOCUMENTS

| | | | |
|---|---|---|---|
| 4,439,777 | 3/1984 | Aprato | 346/76 |
| 4,718,785 | 1/1988 | Spath | 400/120 |
| 4,750,880 | 6/1988 | Stephenson et al. | 400/120 |
| 4,830,523 | 5/1989 | Sparer et al. | 400/120 |
| 4,911,567 | 3/1990 | Fujihira | 400/120 |
| 4,938,616 | 7/1990 | Shiozaki et al. | 347/197 |
| 4,949,098 | 8/1990 | Gluck et al. | 346/76 |
| 4,962,392 | 10/1990 | Okuno et al. | 346/145 |
| 4,990,937 | 2/1991 | Tashiro et al. | 346/139 |
| 5,005,026 | 4/1991 | Sakai | 346/76 |
| 5,055,858 | 10/1991 | Koch | 346/76 |
| 5,064,300 | 11/1991 | Kashiwaba | 400/56 |
| 5,106,212 | 4/1992 | Endo et al. | 400/120 |
| 5,114,251 | 5/1992 | Mahoney | 400/120 |
| 5,157,415 | 10/1992 | Seyasu | 347/197 |
| 5,366,302 | 11/1996 | Masumura et al. | 347/197 |

FOREIGN PATENT DOCUMENTS

| | | | |
|---|---|---|---|
| 0094469 | 5/1982 | European Pat. Off. . | |
| 0141571 | 6/1986 | Japan | 347/197 |

OTHER PUBLICATIONS

Patent Abstracts of Japan, vol. 11 No. 385 (M-651) (2832) 16 Dec. 1987 re JP-A-62 152882.

Patent Abstracts of Japan, vol. 16 No. 87 (M-1217) 3 Mar. 1992 re JP-A-03 268983.

*Primary Examiner*—Huan H. Tran

[57] ABSTRACT

A thermal printer mechanism includes a print head assembly for locating a print head at a predetermined optimum position for printing or at a cleaning position and an adjustable guide path assembly for maintaining the center line of print stock aligned with the centerline of the print head for different widths of stock. The print head assembly includes a print head supported by a mounting bracket so that the head is maintained in a predetermined fixed position with respect to the platen shaft. A head force bracket sums the force from a pair of springs and applies it via a pivot shaft to the midpoint of the line of tangency of the print head with the platen roller so that the print head "floats" on the roller. The print head assembly can be pivoted from the printing position to a cleaning position by changing the positions of pins in a pair of camming slots. The print stock guide path assembly includes left and right guide racks engaged by a common pinion so that the width of the guide path may be easily adjusted while maintaining the center line of the guide path aligned with the center line of the print head.

11 Claims, 5 Drawing Sheets

PRINTER MECHANISM

BACKGROUND OF THE INVENTION

This invention relates to printers and more particularly to an improved thermal printer mechanism for printing of labels or the like.

In the thermal printing of heat sensitive labels and the like the label stock is guided between a thermal print head and a driven platen roller. Electrical signals are provided to the print head to cause sequences of lines of desired characters to be formed on the label. Typically, thermal printers have the print head so mounted as to allow adjustment with respect to the platen roller to achieve the best available print quality by trial and error. Further, it is usual for thermal label printers to print labels of different widths and in so doing to maintain the label stock justified to one side of the print head for all widths. When the ratio of maximum to minimum label widths exceeds a certain point an adjustment may be required between the print head and the platen roller to obtain acceptable print quality for narrow labels. Typically, this adjustment causes the head to be tilted to closer proximity to the platen roller for narrow labels.

Thus, while thermal label printers provide significant advantages in many applications, known printers suffer from the disadvantages described above as well as others. For example, most thermal label printers in use today provide very limited access to the head and platen for cleaning and/or clearing of jammed label stock. This tends to encourage the operator to attempt to clear jammed stock with metal objects such as knives and screw drivers which can damage the print heads and platens.

SUMMARY OF THE INVENTION

A general object of this invention is to provide a thermal printer mechanism which substantially eliminates the disadvantages described above in known thermal label printers.

A more particular object is to provide a thermal printer mechanism in which no adjustment of the print head is required and with automatic alignment of the print line with the platen shaft and uniform contact pressure across the print line.

Another object of this invention is to provide a thermal printer mechanism in which the print stock is guided in a path centered toward the print head with provision for adjusting the width of the path to accommodate stock of various widths.

Yet another object of this invention is to provide a thermal printer mechanism which permits easy and complete access to the print head, stock path and platen for cleaning and for clearing jammed stock.

A thermal printer mechanism embodying the present invention includes a frame, a platen having a shaft mounted on the frame for rotation with respect thereto and a thermal print head having a print line defined thereon. Mounting means are provided for supporting the print head in a predetermined fixed position with respect to the platen so that the print head has a line of tangency with the platen substantially parallel to the platen shaft and has a center line extending through the midpoint of the line of tangency and substantially perpendicular to it. Force means is connected between the frame and the mounting means for applying force along the center line to resiliently urge the print head into contact with the platen at the line of tangency.

The print head is preferably supported in a predetermined fixed position so that the line of tangency with the platen is substantially parallel to the print line on the print head and offset from the print line in the direction of print stock travel.

Preferably, a flange is provided on the mounting means substantially aligned with the center line and a pivot shaft is mounted on the force means for engaging the flange. A spring causes the force means to pivot about the pivot shaft and apply force to the print head at the midpoint of the line of tangency.

The flange preferably includes a slot substantially aligned with the center line and the pivot shaft engages the slot so that the print head is free to pivot about the center line and be self-adjusting along the line of tangency.

Further, a pivot means may be provided connecting the force means to the spring and with camming slots being formed in the frame. The arrangement is such that the pivot means is moveable in the camming slots from a first position where the force means is pivoted about the pivot shaft to resiliently urge the print head into contact with the platen to a second position where the force means is pivoted about the pivot means to move the print head out of contact with the platen to permit access to the platen and the print head.

In addition, a guide assembly may be provided which defines a guide path for guiding print stock along the center line towards the line of tangency. The guide assembly preferably includes first and second guide racks spaced apart on opposite sides of the center line and a pinion engaging the racks to move each an equal distance toward or away from the center line to adjust the width of the guide path.

DESCRIPTION OF A PREFERRED EMBODIMENT

Figure 1:
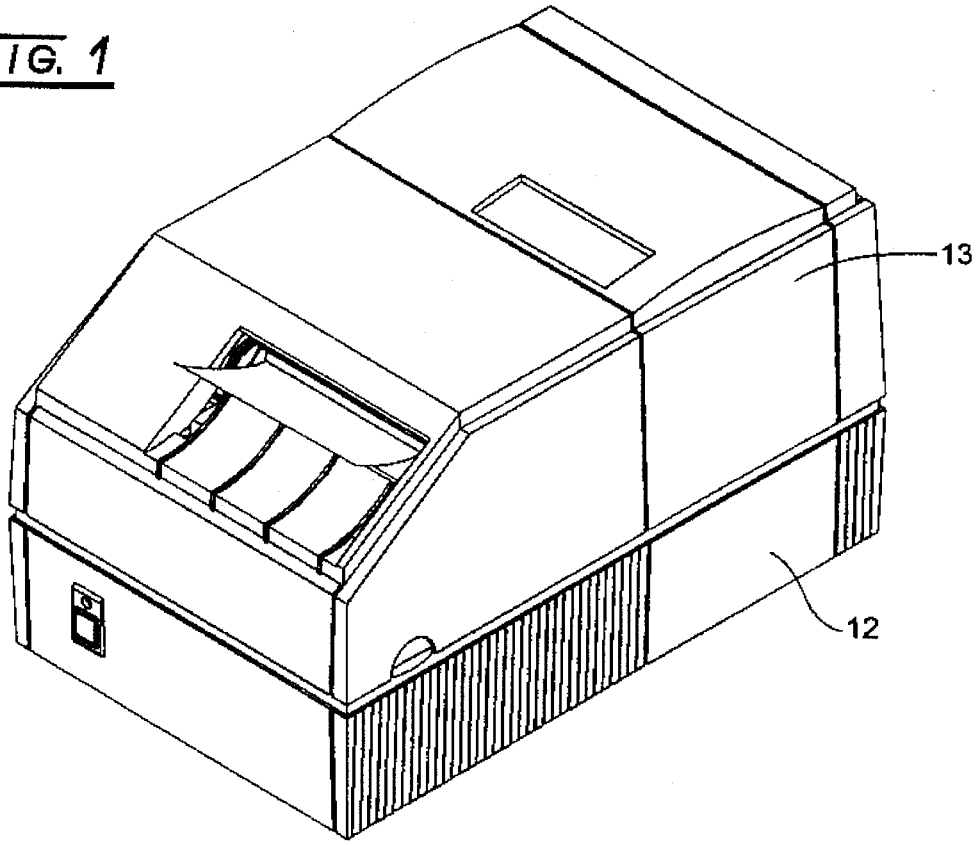
FIG. 1 is a perspective view of a thermal label printer embodying the present invention.
Figure 2:
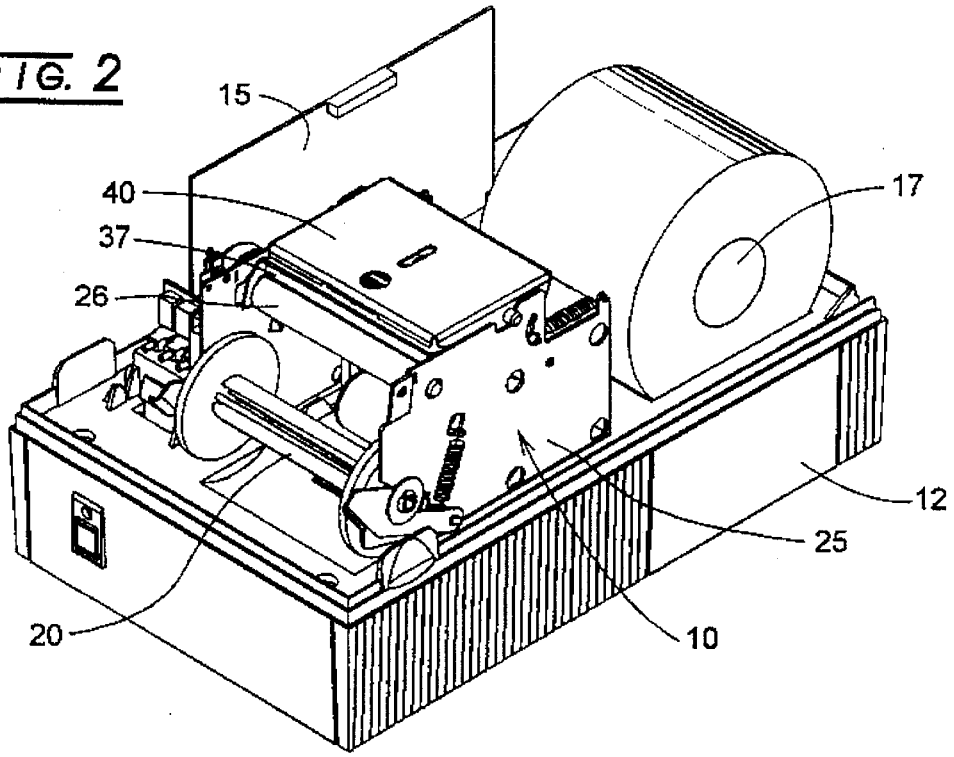
FIG. 2 is a perspective view of the printer of FIG. 1 with the top cover removed to reveal the printer mechanism.
Figure 3:
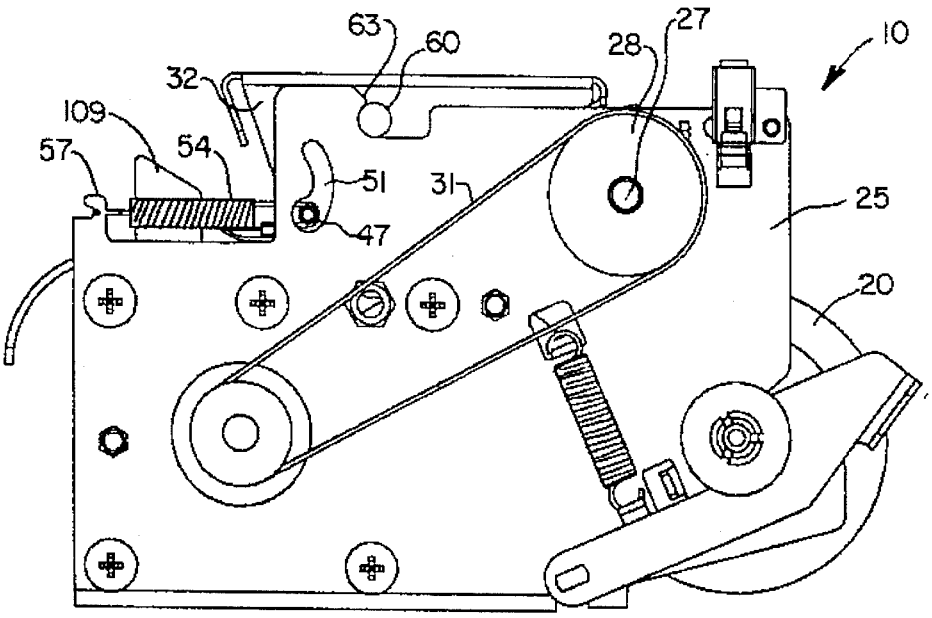
FIG. 3 is a side elevational view of the printer mechanism shown in FIG. 2.
Figure 4:
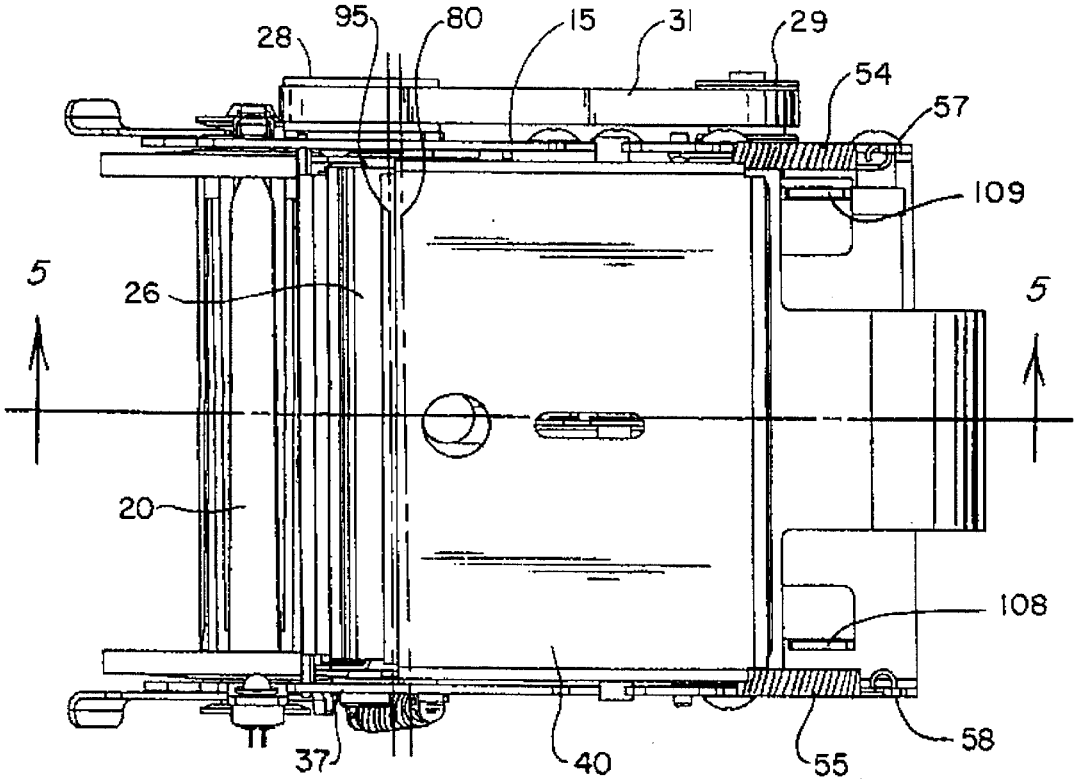
FIG. 4 is a top plan view of the printer mechanism shown in FIG. 2.

Referring initially to FIGS. 1–5, a thermal printer embodying a printer mechanism according to the present invention includes the printer mechanism generally designated 10, a base 12 and a cover 13. A printed circuit board (PCB) 15 is mounted on base 12 alongside printer mechanism 10. PCB 15 includes electronic circuits which form no part of the present invention for providing data to printer mechanism 10. A roll 17 for storing labels or similar print stock is also supported on base 12 along with a take-up roller 20. In operation, the labels or other stock are supplied from roll 17 and passed through printer mechanism 10 where the desired data is printed thereon and the liner is stripped therefrom. The liner is stored on the take-up roller 20.

Figure 5:
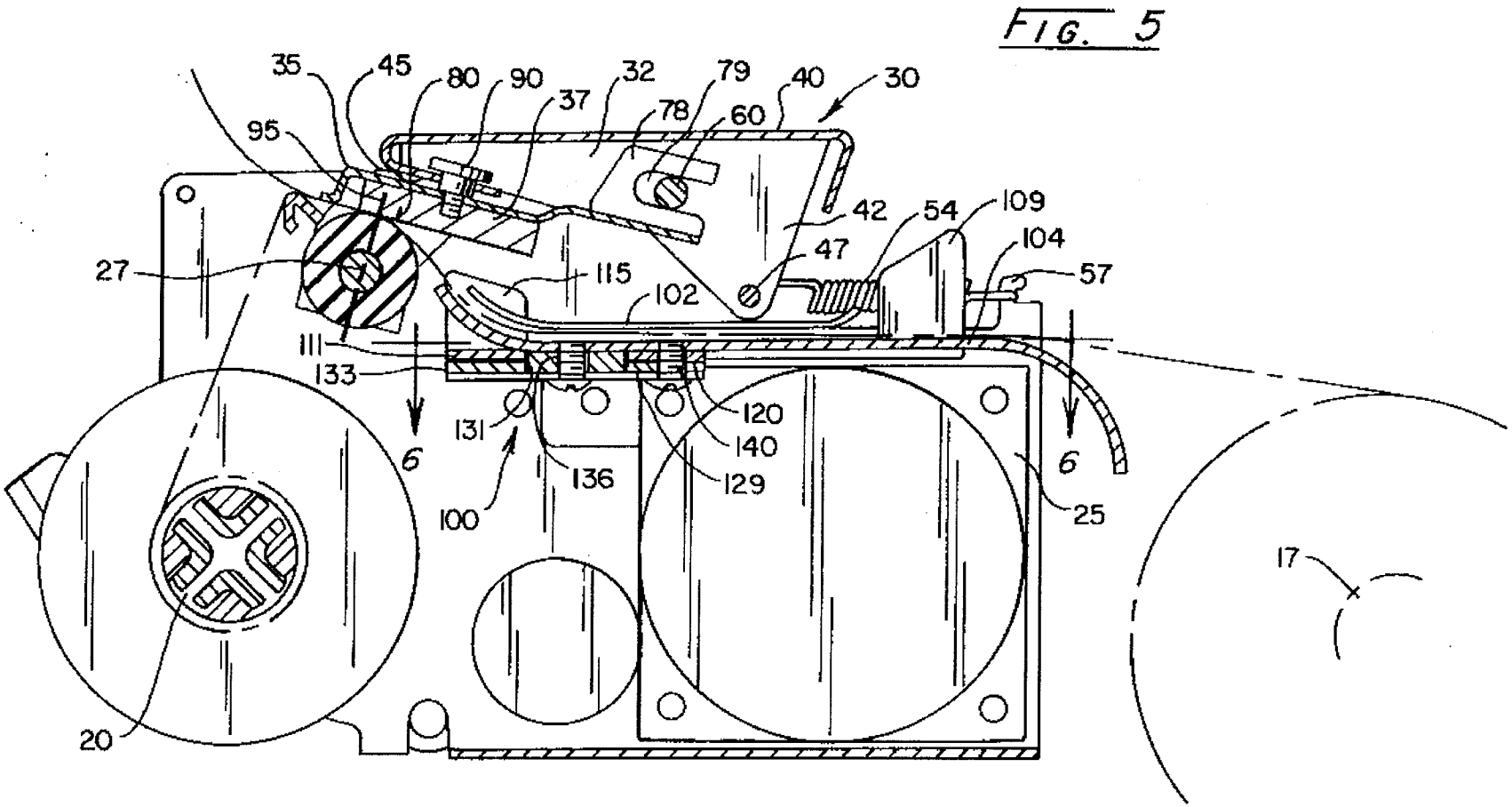
FIG. 5 is a vertical sectional view on the line 5—5 of FIG. 4.

Printer mechanism 10 includes a metal frame 25 which supports a platen roller 26 preferably formed of silicone. A silicone platen suitable for use in this invention may be obtained from Rubber/Urethanes, Inc., in Azusa, Calif. Platen 26 is supported on frame 25 by a shaft 27 driven by a small stepper motor (not shown) through pulleys 28, 29 and drive belt 31. Frame 25 also supports, as shown in FIG. 5, an assembly generally designated 30 for fixing the print head of the printer mechanism in a predetermined optimum fixed printing position with respect to platen roller 26. In this position the print head is permitted to "float" and adjust itself to have uniform contact pressure with platen roller 26 across the entire width of the print head.

Figure 9:
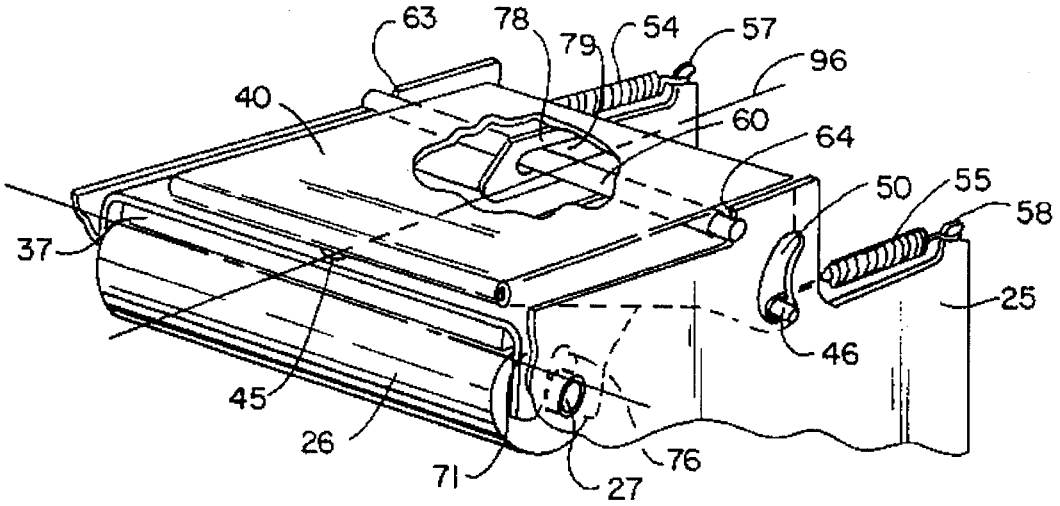
FIG. 9 is a perspective view of a print head assembly, including print head, mounting bracket and force bracket, connected in printing position to the platen roller and printer frame.
Figure 10:
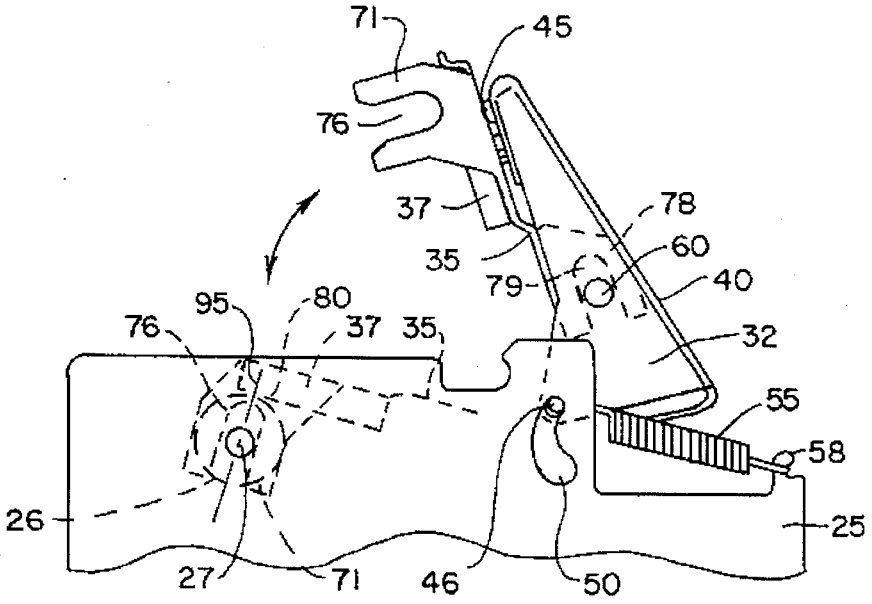
FIG. 10 is a side view of the apparatus of FIG. 9 with the print head assembly moved to the cleaning position.

The print head assembly 30 includes a print head force bracket generally designated 32, a print head mounting bracket generally designated 35 and a thermal print head 37. As shown in FIGS. 5, 9 and 10, force bracket 32 is formed of stamped metal and includes an upper plate 40 with a pair of arms or flanges 42, 44 extending downwardly from the opposite lateral sides of plate 40. A projection or button 45 is formed on the bottom of plate 40 for a purpose that will become apparent below. Force bracket 32 is connected to frame 25 by means of pins 46, 47 which extend through the vertex portion of each flange 42, 44 and into the respective bottoms of a pair of camming slots 50, 51 formed in frame 25. Pins 46, 47 are retained in the bottoms of slots 50, 51 by means of springs 54, 55 connected at one end to the pins and at the other end to retaining hooks 57, 58 formed in frame 25. The rearward end of force bracket 32, and of the entire print head assembly 30, is thereby retained resiliently connected to frame 25.

Force bracket 32 is also provided with a pivot shaft 60 which extends laterally across its width and projects on each side through flanges 42, 43. The projecting ends of shaft 60 are positioned in a pair of detents 63, 64 formed in frame 25 to anchor bracket 32 and assembly 30 against the force exerted by springs 54, 55. Head force bracket 32, and print head assembly 30, is thus connected to frame 25 at one pair of points by means of pins 46, 47 and at another pair of points by means of shaft 60 positioned in detents 63, 64.

Referring now primarily to FIGS. 5, 8, 9 and 10, print head mounting bracket 35 includes a top plate 68 and a pair of downwardly extending side flanges 70, 71 having slots 75, 76 formed therein. Head mounting bracket 35 also includes an upwardly extending flange 78 having a rearwardly extending slot 79 formed therein. Print head mounting bracket 35 is connected at its rearward end to force mounting bracket 32 by means of engagement between pivot shaft 60 on bracket 32 and slot 79. Flange 78 is positioned on head mounting bracket 35 so that the vertical plane containing slot 79 bisects the width of mounting bracket 35. Head mounting bracket 35 is connected at its forward end to platen roller 26 by means of engagement between platen roller shaft 27 and slots 75, 76 in flanges 70, 71.

Figure 7:
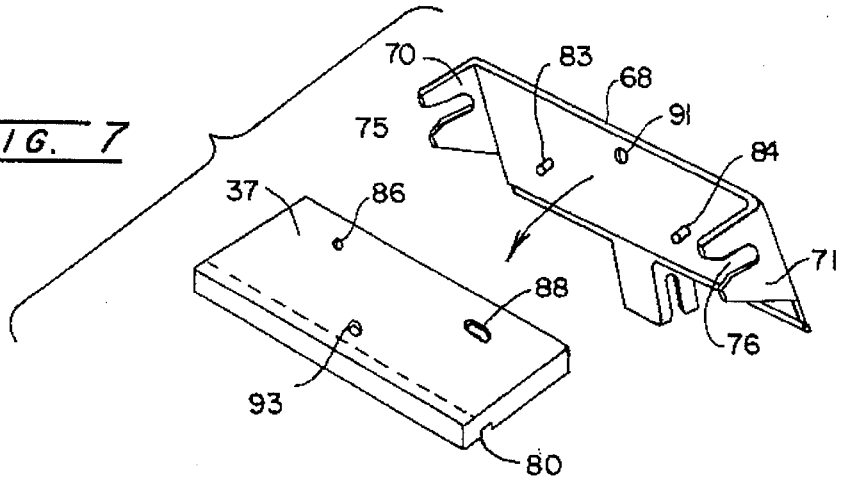
FIG. 7 is a perspective view of a print head and print head mounting bracket according to the present invention.

Referring now primarily to FIGS. 5, 7 and 10, thermal print head 37 has a print line 80 defined thereon. Head 37 is fixed in a predetermined desired position on head mounting bracket 35 by means of pins 83, 84 formed in the bottom surface of head mounting bracket 35 which mate with a hole 86 and a slot 88 formed in the upper surface of print head 37. Print head 37 is permanently fastened to head mounting bracket 35 by means of a threaded member 90 extending through hole 91 in mounting bracket 35 and into a threaded opening 93 in print head 37. Print head 37 is thus fixed in the desired position on head mounting bracket 35. A preferred form of print head 37 may be purchased from Rohm Electronics as Model No. KM-2003-A2.

Figure 8:
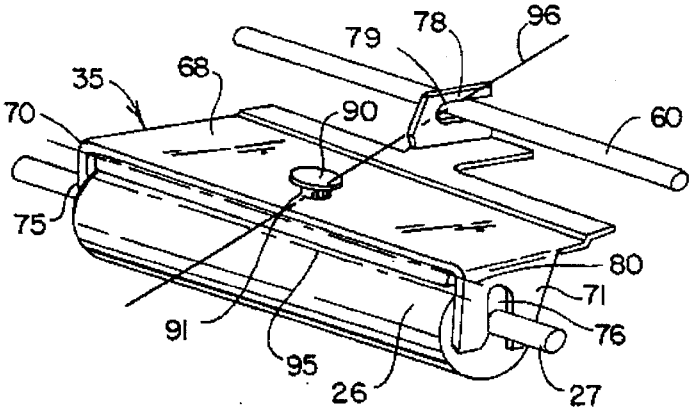
FIG. 8 is a perspective view of the assembled print head and mounting bracket of FIG. 7 mounted on a platen roller in accordance with the present invention.

The print head assembly 30 described above and comprising print head 37, print head mounting bracket 35 and head force mounting bracket 32 provides a number of advantages. In the printing position shown in FIGS. 5 and 9, assembly 30 positions the print head so that it has a line of tangency, indicated at 95, with platen roller 26 that is parallel to platen shaft 27 and to print line 80 and offset from the latter. The position of print line 80 relative to the line of tangency 95 is important to print quality. It is preferred that print line 80 be off-set slightly to the rear (opposite to the direction of print stock travel) of the line of tangency 95 as shown in FIGS. 5, 8 and 10. The amount of offset may be about 0.010 inches. Print head 37 is fixed on head mounting bracket 35 so that the print line is accurately located relative to alignment slots 75, 76 and, therefore, to platen roller shaft 27. Engagement of the alignment slots 75, 76 on platen shaft 27 maintains the line of tangency 95 and the print line parallel to the axis of platen roller shaft 27. A line perpendicular to the midpoint of the line of tangency 95 and intersecting its midpoint lies in the vertical plane containing slot 79 in flange 78 and defines a center line 96 that passes through slot 79. Button 45 on force bracket 32 is positioned to be on centerline 96.

The print head 37 and mounting bracket 35 are restrained from any tendency to rotate with platen roller 26 by engagement of pivot slot 79 with the pivot shaft 60 on head force mounting bracket 32. This engagement between shaft 60 and slot 79 allows print head 37, with flange 78, to pivot slightly about center line 96, an axis perpendicular to platen shaft 27. Print head 37 thereby automatically adjusts to the platen roller 26 to achieve uniform contact pressure at the line of tangency 95 across the entire width of the print head. In the printing position of print head assembly 30 show in FIGS. 5 and 9, pivot shaft 60 operates as a pivot axis for assembly 30. The resilient force provided by springs 54, 55 tends to rotate force bracket 32 about shaft 60. Head force bracket 32 thus sums the force provided by springs 54, 55 and transmits it through button 45 to the mid point of the line of tangency 95.

The arrangement described above allows print head 37 to "float" and align itself with the platen roller 26 while ensuring that force is applied to the print head in a controlled manner without introducing moments or uneven loads to it. Print head 37 is optimally positioned relative to platen roller 26 without the need for adjustments. This reduces assembly labor and produces more reliable long term print quality since the print head cannot get out of adjustment or be misadjusted by service personnel.

According to another feature of this invention, print head assembly 30 can be pivoted from the printing position shown in FIGS. 5 and 9 to the position shown in FIG. 10. In the latter position full access is provided to the print head, the platen roller and the guide path for the print stock for head replacement, cleaning and clearing jammed stock. As described above, in the printing position of FIGS. 5 and 9 pivot shaft 60 engages detents 63 and 64 and pins 46, 47 are engaged in the bottom portion of camming slots 50, 51. In this position, pivot shaft 60 is a pivot axis for head force bracket 32 and the print head assembly 30. The print head assembly may be pivoted to the cleaning position shown in FIG. 10 by pulling head force bracket 32 forwardly to release the ends of pivot shaft 60 from their engagement with detents 63, 64. Pins 46, 47 can then ride up the camming surfaces of camming slots 50, 51 to the positions shown in FIG. 10 where the pins become a pivot axis for the print head assembly. In this position, the force vectors of springs 54, 55 pass through the pivot axis of print head assembly 30 allowing it to pivot about pins 46, 47 and move to the cleaning position shown in FIG. 10. Print head assembly 30 may be returned to the printing position by moving it forwardly and downwardly so that slots 75, 76 are engaged by platen roller shaft 27, pins 46, 47 return to the bottom of camming slots 50, 51 and the ends of pivot shaft 60 engage detents 63, 64.

Figure 6:
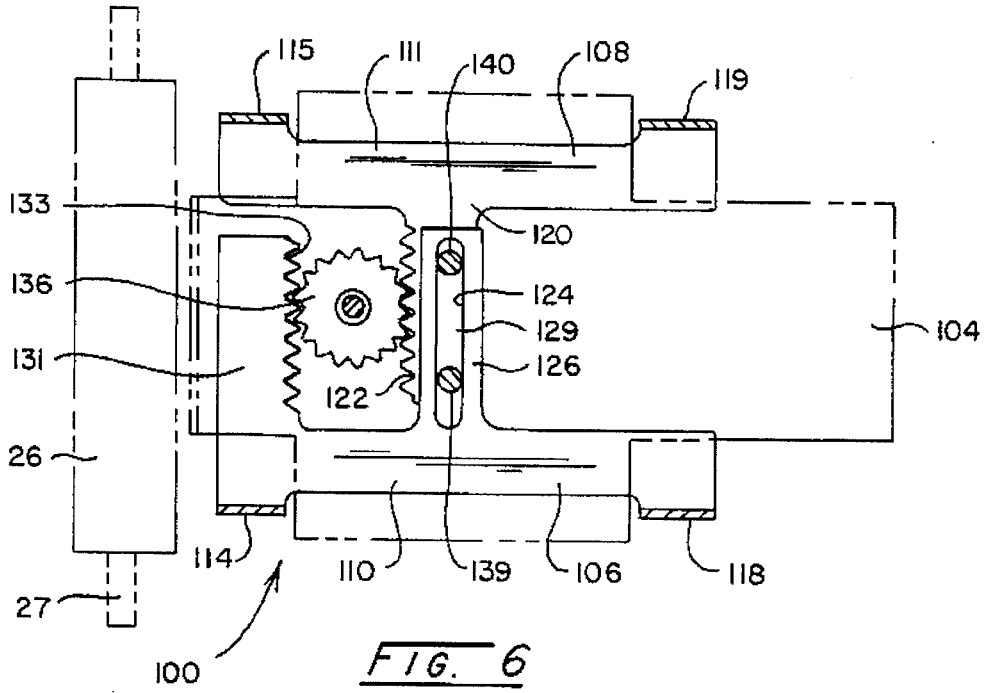
FIG. 6 is a horizontal sectional view on the line 6—6 of FIG. 5.

Referring now primarily to FIGS. 5 and 6, the printer mechanism of the present invention provides a print stock guide path that allows various widths of stock to be centered on the width of the print head. As shown in FIGS. 5 and 6, the print stock guide assembly is generally designated 100 and includes an upper guide member 102 and a lower guide member 104 between which the print stock is guided to a path between platen roller 26 and print head 37. A width adjustment mechanism is provided below the guide member 104 and supporting it. The width adjustment mechanism includes a left guide rack 106 and a right guide rack 108. Each guide rack includes an elongated portion 110, 111, respectively, extending parallel to the direction of stock flow and terminating at one end in a front guide tab 114, 115, respectively, and at the other end in a rear guide tab 118, 119, respectively. Right guide rack 108 includes a rack arm 120 extending toward left rack 106 and provided on one edge with a gear rack 122 and an elongated slot centrally located at 124. Left guide rack 106 is provided with a corresponding locking arm 126 overlying the rack arm 120 and provided with a mating slot 129. Left guide rack 106 is also provided with a rack arm 131 having a gear rack 133 on one edge thereof facing gear rack 122. A pinion 136 engages both gear racks 122 and 133. Guide racks 106 and 108 are retained in position by means of studs 139 and 140 which fit through the overlapping slots 124, 129 and are mated with spring washers (not shown) to secure the guide racks together with limited clamping force.

The width of the stock guide path may be adjusted while maintaining its centered position with respect to print head 37 by moving either of guide racks 106 or 108 toward or away from the other against the limited clamping force of the studs and spring washers to narrow or widen the guide path as desired. Because of the rack and pinion engagement, movement of either guide rack 106 or 108 will cause the other to move an equal amount in a corresponding direction thus adjusting the width of the guide path while maintaining the centered position of the print stock. Thus, by means of the adjustable guide path assembly the print stock is kept centered on the width of the print head. This provides optimal cooperation with the print head since the head is arranged to "float" with respect to resilient force applied at the midpoint of its line of tangency with the platen roller.

What is claimed is:

1. A thermal printer mechanism comprising a frame, a platen having a shaft mounted on said frame for rotation with respect thereto, a thermal print head, means supporting said print head in predetermined fixed position with respect to said platen such that said print head has a line of tangency with said platen substantially parallel to said shaft said line of tangency having a midpoint and said patient head having a center line extending through the midpoint of said line of tangency and substantially perpendicular thereto, means urging said print head into contact with said platen at said line of tangency, and a guide assembly defining a guide path for guiding print stock along said center line and towards said line of tangency, said guide assembly including first and second guide racks spaced apart on opposite sides of said center line and a pinion engaging said racks to move each an equal distance toward or away from said center line to adjust the width of said guide path.

2. A thermal printer mechanism comprising a frame, a platen having a shaft mounted on said frame for rotation with respect thereto, a thermal print head, mounting means for supporting said print head in predetermined fixed position with respect to said platen such that said print head has a line of tangency with the platen substantially parallel to said shaft, said line of tangency having a midpoint, said print head having a center line extending through the midpoint of the line of tangency and substantially perpendicular thereto, a flange on said mounting means substantially aligned with said center line, force means connected between said frame and said mounting means, a pivot shaft mounted on said force means and engaging said flange, resilient means causing said force means to pivot about said pivot shaft and apply force to said print head at the midpoint of said line of tangency to urge said print head into resilient contact with said platen, pivot means connecting said force means to said resilient means, and camming slots formed in said frame, said pivot means being moveable in said camming slots from a first position wherein said force means is pivoted about said pivot shaft to resiliently urge said print head into contact with said platen to a second position wherein said force means is pivoted about said pivot means to move said print head out of contact with said platen to permit access to said platen and print head.

3. A thermal printer mechanism comprising a frame, a platen having a shaft mounted on said frame for rotation with respect thereto, a thermal print head having a print line defined thereon, a print head assembly for supporting said print head in predetermined fixed position with respect to said platen such that said print head has a line of tangency with said platen substantially parallel to said shaft and to said print line and offset from said print line in the direction of print stock travel, said line of tangency having a midpoint, said print head being supported to have a center line extending through the midpoint of said line of tangency and substantially perpendicular thereto, means connected to said print head assembly defining a pivot axis therefor, spring means causing said assembly to pivot about said pivot axis and apply force to said print head at the midpoint of said line of tangency to urge said print head into resilient contact with said platen, camming slots formed in said frame, and means on said print head assembly moveable in said camming slots to a position defining an alternate pivot axis wherein said print head assembly is pivoted about said alternate axis to move said print head out of contact with said platen to permit access to said platen and print head.

4. A thermal printer mechanism as claimed in claim 3 wherein said print head assembly includes a flange having a slot formed therein substantially aligned with said center line, said slot engaging said pivot axis so that said print head is free to pivot about said center line, whereby said print head is self-adjusting along said line of tangency.

5. A thermal printer mechanism as claimed in claim 3 including a pair of flanges on said print head assembly, said flanges having slots engagable with said platen shaft to maintain said print head in position with respect to said platen.

6. A thermal printer mechanism comprising a frame, a platen having a shaft mounted on said frame for rotation with respect thereto, a thermal print head, a mounting bracket supporting said print head, said mounting bracket having a pair of flanges engagable with said platen shaft for maintaining said print head in predetermined fixed position with respect to said platen such that said print head has a line of tangency with the platen substantially parallel to said shaft, said line of tangency having a midpoint, said print head being positioned to have a center line extending through the midpoint of the line of tangency and substantially perpendicular thereto, a force bracket contacting said mounting bracket at a first point on said center line for transmitting force to said print head to urge said print head into resilient contact with said platen, a pivot shaft mounted on said force bracket and extending substantially perpendicular to said center line and contacting said mounting bracket at a second point on said center line, and resilient means causing said force bracket to pivot about said pivot shaft and transmit force to said mounting bracket at said first point to urge said print head into resilient contact with said platen.

7. A thermal printer mechanism as claimed in claim 6 wherein said resilient means includes at least one spring connected between said force bracket and said frame.

8. A thermal printer mechanism as claimed in claim 7 wherein said first point on said center line is at the midpoint of the line of tangency.

9. A thermal printer mechanism as claimed in claim 7 wherein said mounting bracket includes a flange having a slot formed therein contacting said pivot shaft at said second point so that said print head is free to pivot about said center line, whereby said print head is self-adjusting along said line of tangency.

10. A thermal printer mechanism as claimed in claim 7 wherein said print head has a print line defined thereon, and wherein said print head is supported by said mounting bracket so that said line of tangency is substantially parallel to said print line and offset therefrom in the direction of print stock travel.

11. A thermal printer mechanism as claimed in claim 6 including at least one projecting pin on said mounting brackets and an opening formed in said print head to receive said pins and secure said print head in fixed position with respect to said mounting means.

* * * * *